US005327612A

United States Patent [19]

Kelsay

[11] Patent Number: 5,327,612

[45] Date of Patent: Jul. 12, 1994

[54] PLASTIC MOLDED TROWEL HANDLE HAVING FINGERGUARD AND PALM GRIP

[75] Inventor: Curtis D. Kelsay, Springdale, Ark.

[73] Assignee: Marshalltown Trowel Company, Marshalltown, Iowa

[21] Appl. No.: 25,622

[22] Filed: Mar. 2, 1993

[51] Int. Cl.[5] ..... B05C 17/10; E04F 21/16

[52] U.S. Cl. ..... 15/235.4; 15/143.1

[58] Field of Search ..... 15/235.4, 235.8, 143.1, 15/245.1; 16/111 R, 116 R

[56] References Cited

U.S. PATENT DOCUMENTS

| | | | |
|---|---|---|---|
| 31,436 | 2/1861 | Bisbee | 15/235.4 |
| 404,667 | 6/1889 | Woodhouse et al. . | |
| 747,036 | 12/1903 | Bishop | 15/235.4 |
| 751,356 | 2/1904 | Smith . | |
| 1,153,575 | 9/1915 | Rowley | 16/116 R |
| 3,302,673 | 2/1967 | Forsberg | 16/111 R |
| 4,316,302 | 2/1982 | Clark | 15/235.4 |
| 4,381,579 | 5/1983 | Rumpp | 16/111 R |
| 4,467,492 | 8/1984 | Harrington | 15/235.4 |
| 4,639,029 | 1/1987 | Kolonia | 16/111 R |
| 4,729,271 | 3/1988 | Kenigson | 16/111 R |
| 4,739,536 | 4/1988 | Bandera et al. | 16/111 R |
| 4,884,312 | 12/1989 | Clark | 15/235.4 |
| 4,941,232 | 7/1990 | Decker et al. | 16/116 R |
| 5,155,878 | 10/1992 | Dellis | 16/111 R |

*Primary Examiner*—Timothy F. Simone
*Assistant Examiner*—Patrick F. Brinson
*Attorney, Agent, or Firm*—McAndrews, Held & Malloy, Ltd.

[57] ABSTRACT

A trowel handle is injection molded from two separate types of plastic. An inner core is molded together with a finger guard from a plastic providing a smooth surface of a first coefficient of friction with the user's hand. The finger guard covers the metal tang of the trowel and protects the user's forefinger and thumb during troweling. An outergrip is molded from a thermoplastic rubber providing a soft, rubber-like surface of a second coefficient of friction with the user's hand.

26 Claims, 1 Drawing Sheet

PLASTIC MOLDED TROWEL HANDLE HAVING FINGERGUARD AND PALM GRIP

BACKGROUND OF THE INVENTION

The present invention relates to a trowel handle and more particularly to a brick trowel handle which is injection molded from two separate types of plastic. A finger guard is integrally molded from a smooth surface thermoplastic resin which serves to protect the user's forefinger and thumb during troweling. An outer palm grip is molded from a thermoplastic rubber having a slightly soft, non-slip, rubber-like feel, surface which serves to provide favorable grippability to the handle and comfort to the user.

Present brick trowels include a flat trowel blade made of metal add have a metal post formed integrally with the blade. The post extends upward from the blade and extends horizontally to become a tang for connecting the handle. The handle is typically made of wood, but in recent years some are formed of plastic. The handle is typically cylindrical in shape.

When plastics such as cellulose acetate butyrate are used for the handle, the low coefficient of friction of the smooth outer surface of the handle allows slippage of the trowel in the user's hand, particularly where the hand becomes wetted from perspiration or mortar. A firm grip upon the handle of a trowel is advantageous to prevent the trowel from turning when troweling the mortar or when its edge is being used for splitting or chipping bricks.

In addition, when trowels are used to spread mortar, or in breaking and trimming bricks, the user tends to position his thumb and forefinger against the metal trowel shank to provide better control in manipulating the trowel. The user's hand is thus prone to become chapped and worn and may develop callouses on the finger and thumb. This is particularly true where the metal shank includes one or more angled surfaces. A major factor promoting callousing of the hand is the presence of mortar. Mortar serves as an irritant by its abrasiveness as well as its chemical effect on the skin.

SUMMARY OF THE INVENTION

Therefore, it is an object of the present invention to overcome the deficiencies of prior art trowels which make use of rough surfaces which chafe the user's fingers while avoiding the problem of smooth surfaces that worsen gripping.

It is a further object of the present invention to provide an improved trowel.

It is yet another object of the present invention to provide a trowel having a finger guard formed of a smooth surface which provides for and protects the fingers of the user during trowel manipulation while simultaneously providing a handle grip of a soft, non-slippery surface.

These and other objects are achieved in a trowel having a grippable, non-slip surface as well as a smooth protective element which prevents chafing contact between the user's hand and the trowel shank. The said protective element is formed of a covering member extending downward from the trowel handle overlaying the rear portion of the shank.

DESCRIPTION OF THE PREFERRED EMBODIMENT

Figure 1:
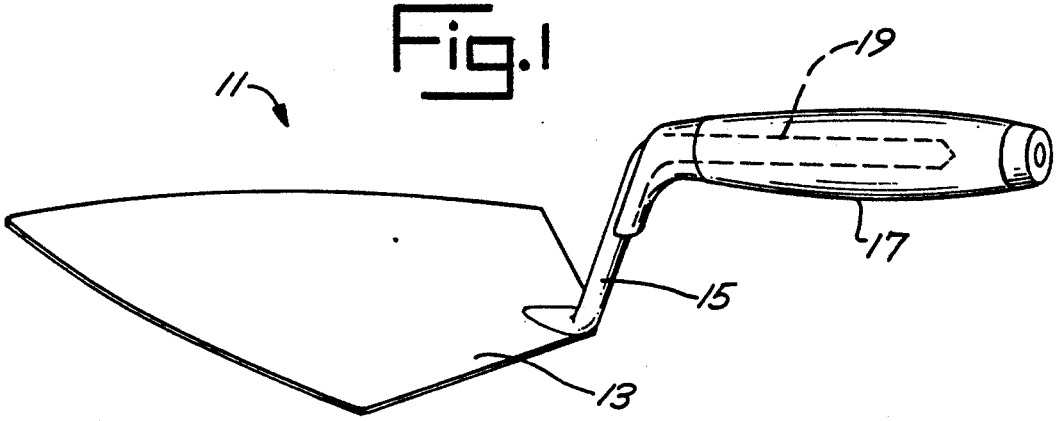
FIG. 1 is a perspective view of a trowel embodiment of the present invention.

Referring to FIG. 1, a trowel 11 is constructed from a flat metal blade 13, a metal shank 15 and a handle 17. Shank 15 is integrally formed with, or is otherwise secured to, the top surface of blade 13 in a conventional manner. Shank 15 extends upwardly from the top surface of the blade providing a metal handle tang 19 which serves as the support structure of handle 17. Tang 19 extends distally from shank 15 and is raised above the plane of blade 13 in a generally parallel disposition thereto. Blade 13, shank 15 and tang 19 are typically forged of metal as one piece.

Figure 2:
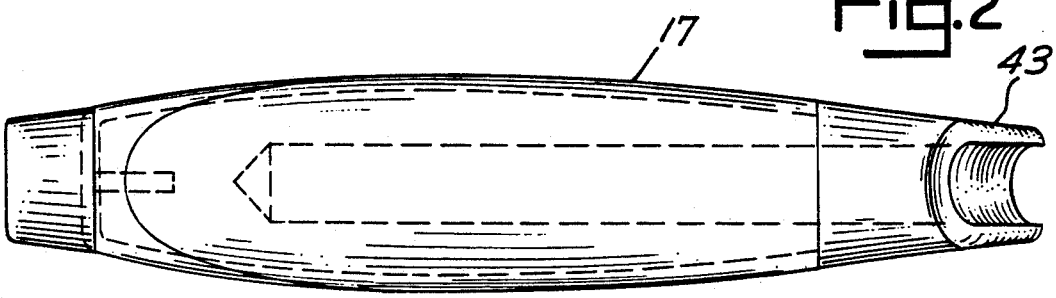
FIG. 2 is a bottom view of the trowel handle of the trowel of FIG. 1.
Figure 3:
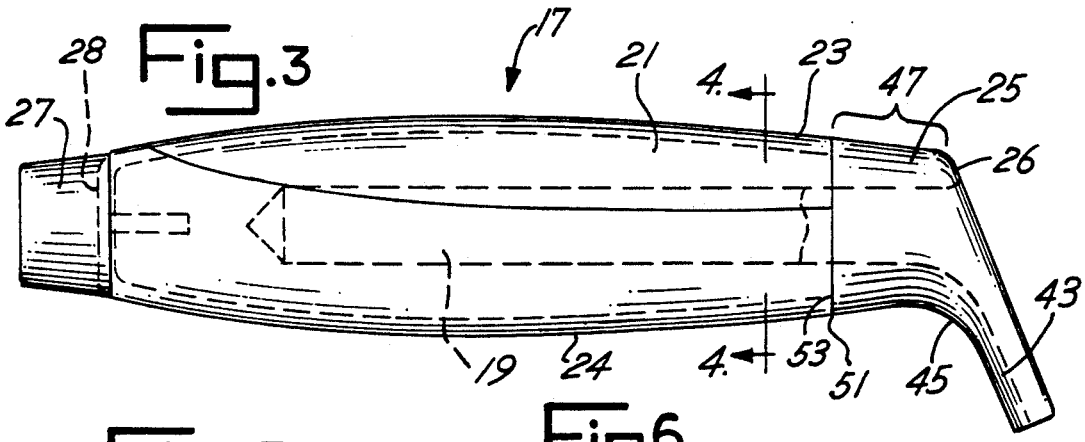
FIG. 3 is a side view of the trowel handle of the trowel of FIG. 1.
Figure 4:
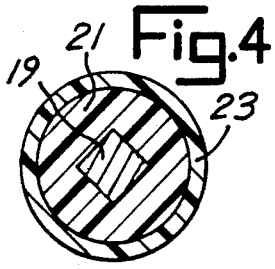
FIG. 4 is a cross-sectional end view of the handle of FIG. 3 taken along line 4—4 in FIG. 3.

Referring to FIGS. 2, 3, and 4, handle 17 includes an inner core 21 and an outer grip 23. A finger guard 25 is disposed at the proximal end of the handle and a bumper 27 is located rearward at the distal end. Inner core 21 is molded integral with finger guard 25 and may be molded or formed directly onto tang 19. The molding may be accomplished by an injection molding procedure and serves to secure core 21 directly onto metal tang 19. As a result, core 21 and finger guard 25 are formed as a single unitary piece and are held fixed to the trowel tang. Tang 19 extends into the inner core approximately three inches.

The inner core 21, fingerguard 25, and outer grip 23 may be formed initially as a unit and then pressed onto tang 19. The unit is formed with a bore for receiving the tang. The assembly may be facilitated in a number of ways including heating of the bore prior to forcing the unit over the tang.

Inner core 21 and finger guard 25 may be formed from polypropylene. The polypropylene forms a hard, durable finger guard 25 and provides a smooth outer surface 26 to the finger guard 25. The smooth outer surface 26 provides a low coefficient of friction with the users hand permitting the user's forefinger and thumb to freely slide along the surface during manipulation of the trowel without a chaffing drag.

As shown in FIGS. 2 and 3, finger guard 25 terminates at a distal end 51 having a circular configuration. From end 51, the inner core 21 extends distally beginning from a proximal end 53 having a circular configuration concentric with and of a diameter smaller than the distal end 51 of finger guard 25. The difference in diameters between ends 51, 53 provides an offset for housing outer grip 23 such that the outer surface 26 of finger guard 25 is contiguous to and flush with the outer surface 24 of grip 23. This provides continuity of surface between the outer surface of grip 23 and the outer surface of finger guard 25.

Figure 5:
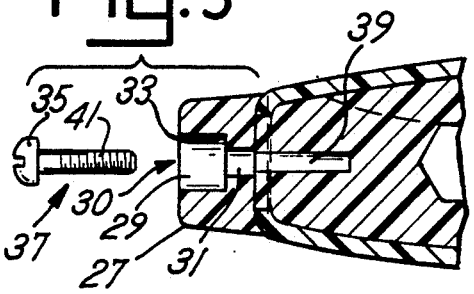
FIG. 5 is a partial cross-sectional side view of the distal end of the trowel handle of FIG. 3.

After the first mold shot of polypropylene has formed inner core 21 and finger guard 25, outer grip 23 is injection molded around the formed inner core 21. Outer grip 23 is generally cylindrical in shape and of a uniform thickness, extending over the majority of the surface area of the handle. Inner core 21 increases in diameter as it extends from its proximal end 53 to the central area of the handle, and thereafter decreases in diameter as it extends to its distal end 28. Distal end 28 need not be covered by outer grip 23, as shown in FIG. 5.

Outer grip 23 may be formed from a thermoplastic rubber, for example, Santoprene TM, a product of Monsanto Corporation. The surface of outer grip 23 may have a smooth or light texture and be felt as slightly soft or pliable like rubber. The outer grip provides a non-slip gripping surface 24 for the user's hand. The gripping surface 24 provides a second and higher coefficient of friction with the user's hand as compared to the coefficient of friction of finger guard 25. Normally the palm of the user's hand together with the user's last three fingers grip the thermoplastic rubber surface.

Rear bumper 27 is a separate piece that is fastened tightly against the distal end 28 of the inner core 21. Rear bumper 27 may be made from a hard, rigid plastic, for example, urethane. The plastic of the bumper is to be able to withstand tapping against brick as is the typical use of the end of a trowel handle by a brick layer.

Figure 6:
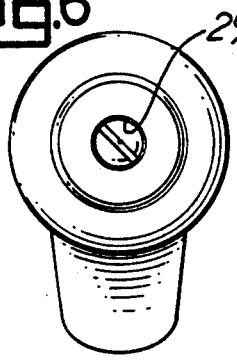
FIG. 6 is an end view of the trowel handle of FIG. 2.

Rear bumper 27 may be securely fastened to the trowel by many conventional means. As shown in FIGS. 5 and 6, bumper 27 includes an aperture 30 passing through it. Aperture 30 is formed of an enlarged cylindrical opening 29 and a smaller concentric cylindrical opening 31. The aperture 30 provides a passage for receiving a screw 37.

An annular stop surface 33 is formed at the base of opening 29 at the interface of, i.e., the meeting of, openings 29 and 31. Stop surface 33 engages the head 35 of screw 37 (and a flat circular washer—not shown—which may be used) when the screw is secured into inner core 23. A bore 39 is formed in the inner core 21 (and outer grip 23 should the outer grip be molded over the distal end 28 of the inner core). Bore 39 receives the screw shank 41 for drawing bumper 27 tightly against end 28. Rear bumper 27 protects the thermoplastic rubber outer grip from being destroyed by the continual tapping of the end of the handle against bricks.

Referring to FIGS. 2 and 3, finger guard 25 is formed to include a depending member 43 which carries a forefinger engaging surface 45. Member 43 partially wraps around the rearward, or distal, surface of shank 15 to cover the shank 15 as shown in FIGS. 2 and 3. Surface 45 provides a wide U-shaped curved surface upon which the user's forefinger may rest during troweling. Finger guard 25 protects the user's finger from direct contact with the shank 15 preventing resulting irritation caused thereby. The outer surface 26 of the finger guard 25 may be smooth in the area of curved surface 45.

Finger guard 25 also includes a generally cylindrical section 47 which is slightly tapered from distal end 51 toward the forward, or proximal, end of the handle 17. Cylindrical section 47 presents a cylindrical outer surface which is smooth and upon which the user may rest his thumb for troweling manipulations.

While only a single, preferred embodiment of the invention has been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A trowel, comprising:
a flat blade;
a shank extending upwardly from the top surface of said blade;
a tang extending from said shank; and
a handle secured to said tang and being disposed above the top surface of said blade, said handle including
(i) an outer grip member formed of a first thermoplastic rubber material and providing a grip surface of a first coefficient of friction with the user's hand;
(ii) an inner core formed of a second more rigid plastic material;
(iii) a protective finger guard formed of said second more rigid plastic material and providing an outer surface having a second coefficient of friction with the user's hand, said finger guard formed integral with said inner core, said finger guard extending downward with respect to said grip surface of said outer grip member and covering the rear portion of said shank for preventing contact between the user's fore finger and said shank when the user grips the handle.

2. The towel of claim 1 wherein said finger guard is shaped to provide said outer surface at the top proximal end of said handle for contact with the thumb of the user's hand.

3. The trowel of claim 1 wherein said first coefficient of friction is higher than said second coefficient of friction.

4. The trowel of claim 1 wherein said inner core is formed about said tang.

5. The trowel of claim 1 wherein said inner core is injection molded about said tang.

6. The trowel of claim 5 wherein said outer grip member is injection molded about said inner core.

7. The trowel of claim 1 wherein said inner core is offset from said finger guard.

8. The trowel of claim 7 wherein said grip surface of said grip member is flush with said outer surface of said finger guard.

9. The trowel of claim 1 and further including a rear bumper secured to the distal end of said handle, said bumper protecting said outer grip member from impact upon the distal end of said handle.

10. The trowel of claim 9 wherein said rear bumper is formed from a hard plastic.

11. The trowel of claim 1 wherein said outer grip member is formed from a thermoplastic rubber material.

12. The trowel of claim 11 wherein said inner core is formed from polypropylene.

13. The trowel of claim 10 wherein said bumper is formed from a tough plastic.

14. A workman's hand tool having a shank, a handle tang, and a handle secured to said tang, said handle including:
(i) an outer grip member formed of a first thermoplastic rubber material and providing a grip surface of a first coefficient of friction with the user's hand;
(ii) an inner core formed of a second plastic material;
(iii) a protective finger guard formed of said second plastic material providing an outer surface having a second coefficient of friction with the user's hand, said finger guard formed integral with said inner core, said finger guard extending downward with respect to said grip surface of said outer grip member for protecting the user's fore finger when the user grips the handle.

15. The trowel of claim 14 wherein said finger guard is shaped to provide said outer surface at the top proximal end of said handle for contact with the thumb of the user's hand.

16. The trowel of claim 14 wherein said first coefficient of friction is higher than said second coefficient of friction.

17. The trowel of claim 14 wherein said inner core is injection molded about said tang.

18. The trowel of claim 17 wherein said outer grip member is injection molded about said inner core.

19. The trowel of claim 14 wherein said inner core is offset from said finger guard.

20. The trowel of claim 19 wherein said grip surface of said grip member is flush with said outer surface of said finger guard.

21. The trowel of claim 14 and further including a rear bumper secured to the distal end of said handle, said bumper protecting said outer grip member from impact at the distal end of said handle.

22. The trowel of claim 21 wherein said rear bumper is formed from a hard plastic.

23. The trowel of claim 14 wherein said outer grip member is formed from a thermoplastic rubber material.

24. The trowel of claim 23 wherein said inner core is formed from polypropylene.

25. The trowel of claim 22 wherein said bumper is formed from a tough plastic.

26. The trowel of claim 14 wherein said inenr core is formed about said tang.

* * * * *